US006028586A

United States Patent [19]

Swan et al.

[11] Patent Number: 6,028,586

[45] Date of Patent: Feb. 22, 2000

[54] METHOD AND APPARATUS FOR DETECTING IMAGE UPDATE RATE DIFFERENCES

[75] Inventors: Philip Lawrence Swan; Edward George Callway; Biljana Dusan Simsic, all of Toronto; Ivan Wong Yin Yang, Markham; David Ian James Glen, North York, all of Canada

[73] Assignee: ATI Technologies, Inc.

[21] Appl. No.: 08/819,922

[22] Filed: Mar. 18, 1997

[51] Int. Cl.[7] ..... G09G 5/00

[52] U.S. Cl. ..... 345/132; 348/385; 348/400; 348/403; 345/213

[58] Field of Search ..... 345/211, 213, 345/115, 116, 302, 327, 328, 132, 127; 382/199; 348/385, 400, 403, 412, 430, 192, 439, 440

[56] References Cited

U.S. PATENT DOCUMENTS

| | | | |
|---|---|---|---|
| 4,135,240 | 1/1979 | Ritchie | 340/172.5 |
| 5,135,079 | 8/1992 | Shimazaki | 187/1 R |
| 5,190,044 | 3/1993 | Kawasaki et al. | 128/661.09 |
| 5,257,113 | 10/1993 | Chen et al. | 358/426 |
| 5,828,381 | 10/1998 | Penna | 345/473 |
| 5,874,937 | 2/1999 | Kesatoshi | 345/127 |

*Primary Examiner*—Lun-Yi Lao
*Assistant Examiner*—Jimmy H. Nguyen
*Attorney, Agent, or Firm*—Markison & Reckamp, PC

[57] ABSTRACT

A method and apparatus for detecting differences between an image update rate and a display update rate and to provide a viable solution that produces minimal adverse visual effects is achieved by first detecting an image delineation from a stream of images. The image delineation is then used to determine the image update rate which is compared to the display update rate to produce a relationship between the two update rates. The relationship is then compared to a plurality of desired relationships to determine if it is sufficiently similar to one or more of the desired relationships. If it is, an image display pattern associated with the desired relationship is used. For example, if the relationship is sufficiently similar to the desired relationship of 1:1, then the image display pattern will be 1111 . . . In other words, the image display pattern would display each received image once. But, even though the relationship is sufficiently similar, the display update is adjusted, such that, over time, the relationship matches the desired relationship.

35 Claims, 8 Drawing Sheets

| Image Update Rates | Display Update Rates | Desired Relationships | |
|---|---|---|---|
| 59.94 Hz | 60 Hz | 1:1 | 2:3 |
| 24 Hz | 90 Hz | 2:5 | 4:15 |
| 50 Hz | | 5:6 | 5:9 |

METHOD AND APPARATUS FOR DETECTING IMAGE UPDATE RATE DIFFERENCES

TECHNICAL FIELD OF THE INVENTION

This invention relates generally to video display and more particularly to displaying a plurality of images on a display, where the image update rate and the display update rate are different.

BACKGROUND OF THE INVENTION

It would be an understatement to say that computers have changed our society. Computers have made it possible to communicate data around the world in seconds, have access to more information than any one person could assimilate in ten life times, and countless other advantages. And, advances in computer technology are occurring every day. For example, video image processing is making dramatic advances in picture quality for all types of image sources such as multimedia imaging, video conferencing, video games, VCR (video cassette recorder), broadcast television, cable television, and DVD (digital video disks), to name just a few.

Displaying video images that were specifically designed to be displayed on a computer display can be done with the utmost of clarity. For example, still images and computer graphical interface images are displayed with great clarity on computer displays where the display rate is 75 Hz, 90 Hz, or 100 Hz. Because of the static nature of these images, the number being prepared for display, or the image update rate, exactly match the display update rate (the number of images the display will present in a second). Similarly, for television, the incoming images have an image update rate that exactly matches the display update rate of the television. In North America the television display update rate is sixty Hertz and in Europe the television display update rate is fifty Hertz.

A difficulty arises when displaying images that were not specifically designed to be displayed on a computer display, such as images from television broadcasts, VCRs, DVDs, and cable television broadcasts. These video transmission mediums have their own image update rates. For example, North American television has an image update rate of 59.94 Hz, while European television has an image update rate of 50 Hz, and motion pictures have an image update rate of 24 Hz. Due to the differences between the image update rate of these video image mediums and the display update rate of the computer display, update rate compensation is needed.

One update rate compensation technique is to reset the display update rate to equal the image update rate. While this overcomes the above mentioned difficulty, it creates a new one. When the display update rate is adjusted for some display devices during a mode change, the screen blanks for a few seconds to reset the display update rate. If the display update rate needs to be changed to initiate video, the blanking of the screen can be quite annoying to the user.

A second update rate compensation technique is to drop or repeat an image when the timing between the image update rate and the display update rate is offset by an image (i.e., becomes a frame out of sync). When the image update rate is faster than the display update rate, images need to be dropped (i.e., not shown). While this keeps the image update rate in sync with the display update rate, the dropping of the images may be noticeable. For example, if the image that is dropped in one in a series of action images (an object is moving), there may be a noticeable jump in the movement of the object because of the dropped image. When the image update rate is slower than the display update rate, images need to be repeated to keep the update rates in sync. The repeated image may produce a noticeable jump for objects in motion, similar to the dropped image. Thus, this technique works well for still image projection, but for movies, sporting events, and other television broadcasts, it is not desirable because of the noticeable jumps.

Therefore, a need exists for a method and apparatus that detects a difference between the image update rate and the display update rate and provides a visually acceptable solution.

DETAILED DESCRIPTION OF THE DRAWINGS

Generally, the present invention provides a method and apparatus for detecting differences between an image update rate and a display update rate and to provide, when needed, a viable solution that produces minimal adverse visual effects. The difference is detected by first detecting an image delineation from a stream of images. The image delineation is then used to determine the image update rate which is compared to the display update rate to produce a relationship between the two update rates. The relationship is then compared to a plurality of desired relationships to determine if it is sufficiently similar to one of the desired relationships. If it is, an image display pattern associated with the desired relationship is used and the display update rate is brought to be equal to the desired relationship over time. For example, if the relationship is sufficiently similar to the desired relationship of 1:1, then the image display pattern will be 1111. . . In other words, the image display pattern would display each received image once. If, however, the relationship is not sufficiently similar to one of the desired relationships, the display update rate is substantially adjusted, but in a manner that produces negligible adverse visual affects. With such a method and apparatus, images from various video image sources (Eg. broadcast television, cable television, motion picture, VCR, and DVD) can be displayed on a computer display with negligible adverse visual affects.

Figure 1:
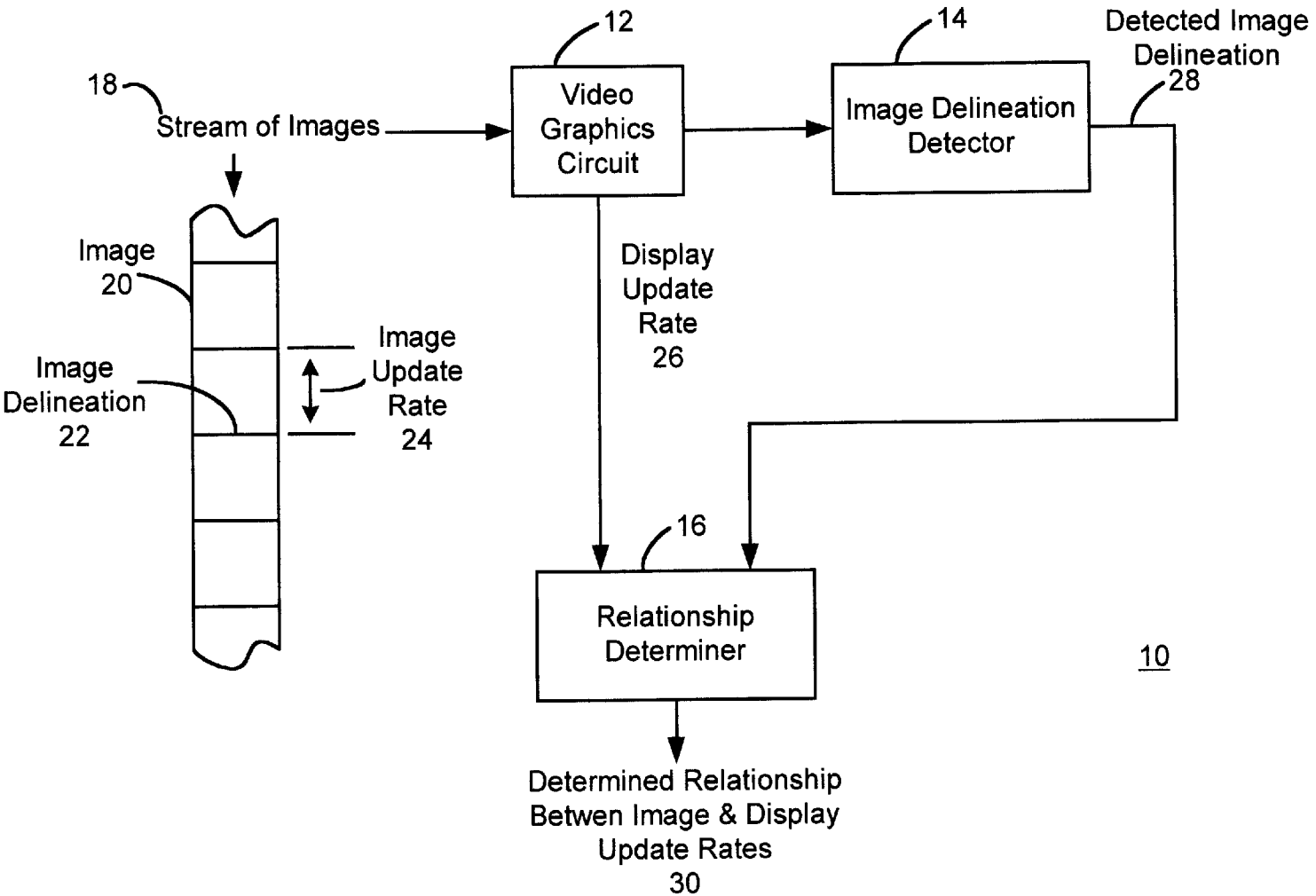
FIG. 1 illustrates a schematic block diagram of an update rate difference detection and adjustment circuit which is in accordance with the present invention.

The present invention can be more fully described with reference to FIGS. 1 through 8. FIG. 1 illustrates a schematic block diagram of an update rate difference detection and adjustment circuit 10 that includes a video graphics circuit 12, an image delineation detector 14, and a relationship determiner 16. The video graphics circuit 12 receives a stream of images 18 and provides at least a portion of the stream of images 18 to the image delineation detector 14. The image delineation detector 14 detects an image delineation 22 and provides it to the relationship determiner 16. The relationship determiner 16 additionally receives a display update rate 26 and determines, therefrom, a relationship between the image update rate and the display update rate and determine whether the relationship is within acceptable limits.

As shown, the stream of images 18 includes a plurality of images 20 and an image delineation 22. Note that an image may be interlaced or non-interlaced, may be updated in variety of formats, and the updates may consist of a complete picture or a portion thereof. The duration of an image is shown to be the image update rate 24. In application, the stream of images may be from a variety of video sources. For example, the stream of images may be supplied by broadcast television, cable television, video games, VCRs, motion pictures, or DVD players to name just a few. The image update rate 24 for these video sources varies: for example, North America broadcast television is 59.94 Hz, European broadcast television is 50 Hz, and motion picture is 24 Hz.

The image delineation detector 14, which may be implemented in software and/or hardware, determines the image delineation 28 in at least one of two ways and such determination is dependent upon how the video graphics circuit 12 receives the stream of images 18. If the stream of images is received directly (i.e., from a video receiver coupled to receive video data from external sources), the image delineation detector 14 interprets the stream of images 18 to detect the image delineation 22. Typically, the stream of images 18 will include an end, or start, of image signal indicating the image delineation, which is readily detectable by the image delineation detector 14. Alternatively, if the video graphics circuit 12 receives a processed version of the stream of images 18, the image delineation detector 14 interprets interchange information sent to a video memory to detect the image delineation.

The relationship determiner 16, having received the detected image delineation, determines, therefrom, the image update rate. This determination can be done in a variety of ways which will be explained in greater detail with reference to FIG. 4, below. The relationship detector 16 then determines a relationship between the image update rate and the display update rate. In essence, this relationship is a ratio between the respective update rates. For example, if the image update rate is 50 Hz and the display update rate (i.e., the refresh rate) is 60 Hz, the relationship is 5:6. Having determined the relationship, the relationship determiner 16 determines if it is sufficiently similar to, or within acceptable limits of, one of a plurality of desired relationships. (FIG. 5, below, illustrates the plurality of desired relationships.) If so, the stream of images can be displayed, based on adjusting the display update rate to maintain, over time, the relationship to be equal to the desired relationship, with negligible adverse visual affects. As with the image delineation circuit 14, the relationship determiner 16 may be implemented in software and/or hardware.

Figure 2:
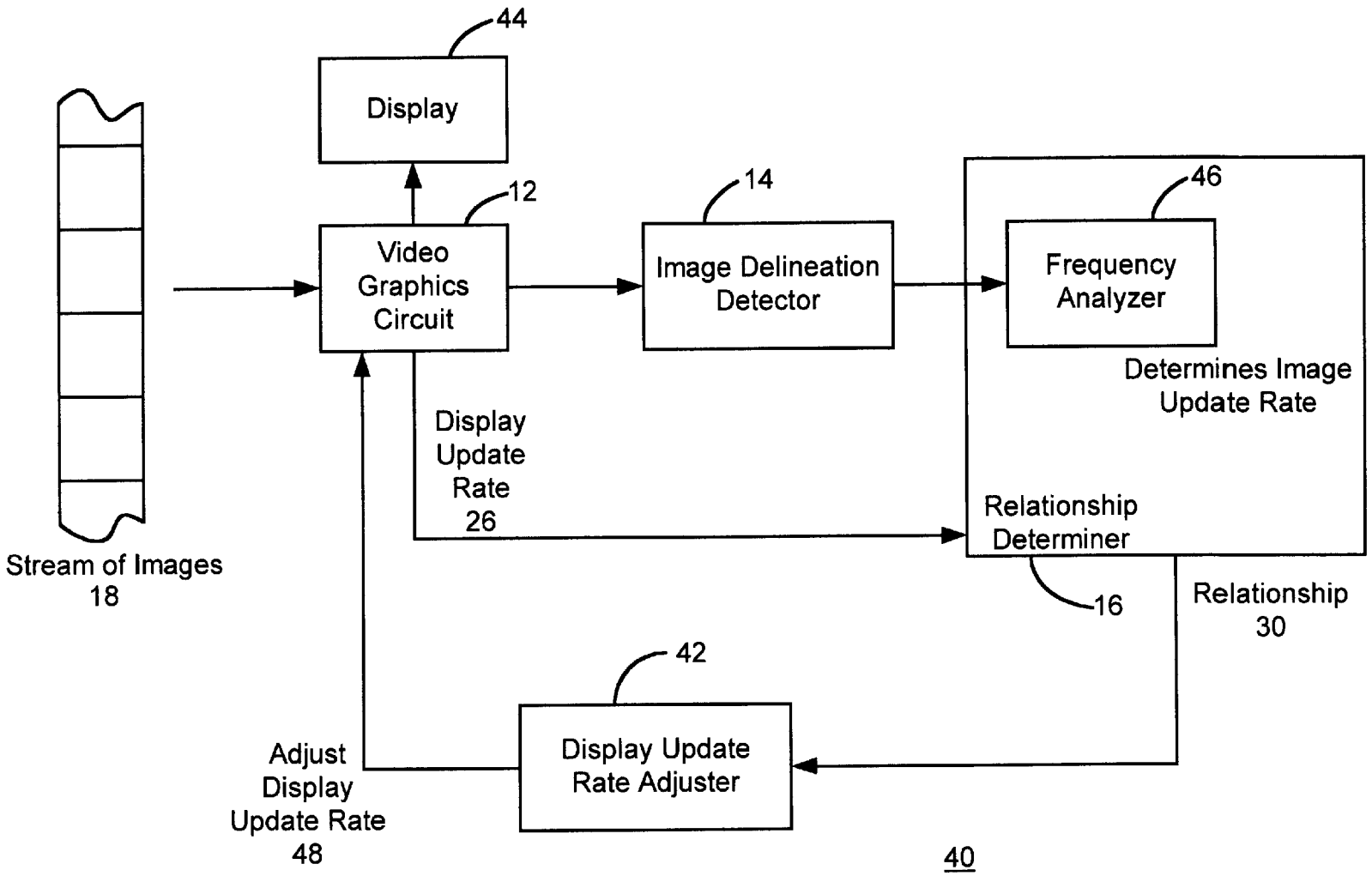
FIG. 2 illustrates a further embodiment of the update rate difference detector and adjustment circuit of the FIG. 1.

FIG. 2 illustrates a further embodiment of the update rate difference detector and adjustment circuit of the FIG. 1. This update rate difference detector and adjustment circuit 40 includes the video graphics circuit 12, the image delineation detector 14, and the relationship determiner 16, but also includes a display update rate adjuster 42 and a display 44 operably coupled to the video graphics circuit 12. The relationship determiner 16 is shown to include a frequency analyzer 46 which performs a frequency analysis, such as a Fourier transform, on the stream of images 18 to determine the image update rate.

As shown, the relationship 30 is provided to the display update rate adjuster 42, which produces, therefrom, an adjust display update rate signal 48. As mentioned in the background section, if the display update rate is changed, the display may blank for a few seconds while resetting or produce some other undesirable effect such as wavering. For the purposes of this disclosure, blanking of the display is considered to be of negligible adverse visual affects when it a very infrequent, such as when the display is turned on, or a video source is changed. For example, if the stream of images 18 has an image update rate of 59.94 Hz, the display update rate can be changed from 60 Hz to 59.94 Hz. While this change to the display update rate may cause the display to reset, the reset would only be done once and thus have negligible adverse visual effects. As an alternate example, assume the image update rate is 24 Hz (representative of motion picture image update rate) and the display update rate is 60 Hz. The resulting relationship is 24:60 which equals the desired relationship of 2:5. For the 2:5 relationship, the adjust display update rate signal 48 includes instructions to display the received images at a display rate pattern of 232323, etc. The display rate patterns will be discussed in greater detail with reference to FIG. 5, below.

As mentioned in the preceding paragraph, 2:5 is a desired relationship. This is the case because a repeatable display rate pattern can be produced therefor which has negligible adverse visual affects. For the 2:5 relationship, a display rate pattern would be 232323. . . which means that one image is displayed twice, the next image is displayed three times, the next image is displayed twice, and so on. For a 60 Hz display update rate, displaying an image for two consecutive displayed images produces, in effect, a display update rate of 30 Hz and displaying an image for three consecutive displayed images produces an effective display update rate of 20 Hz. Taking these values and multiply them by the percentage of time that they occupied the display rate pattern, the resulting effective display update rate is obtained. From this example, 0.4*(30 Hz)+0.6*(20 Hz)=24 Hz. Because each of the individual effective display update rates (30 Hz and 20 Hz) is above the human perception rate of 16 Hz for continual motion, this display pattern produces negligible adverse visual affects.

As an example of a relationship that is not of a desired relationship, assume that the image update rate is 59.94 Hz and the display update rate is 60 Hz. This produces a relationship of 59.94:60, which equals 1:1.001. In essence, what this means is that for every one thousand images received, there would need to be one thousand and one images displayed. Such a pattern would produce a repeated image every one thousand images, or 1000/60=16.67 seconds which, as mentioned in the background section, would be noticeable to human visual perception as a jump in the action. The 1:1.001 relationship, however, is close to a 1:1 relationship, such that the display rate may be adjusted dynamically to achieve the 1:1 relationship on average. Such dynamic adjustments may be done is small, incremental steps, or on a continuum basis.

Figure 3:
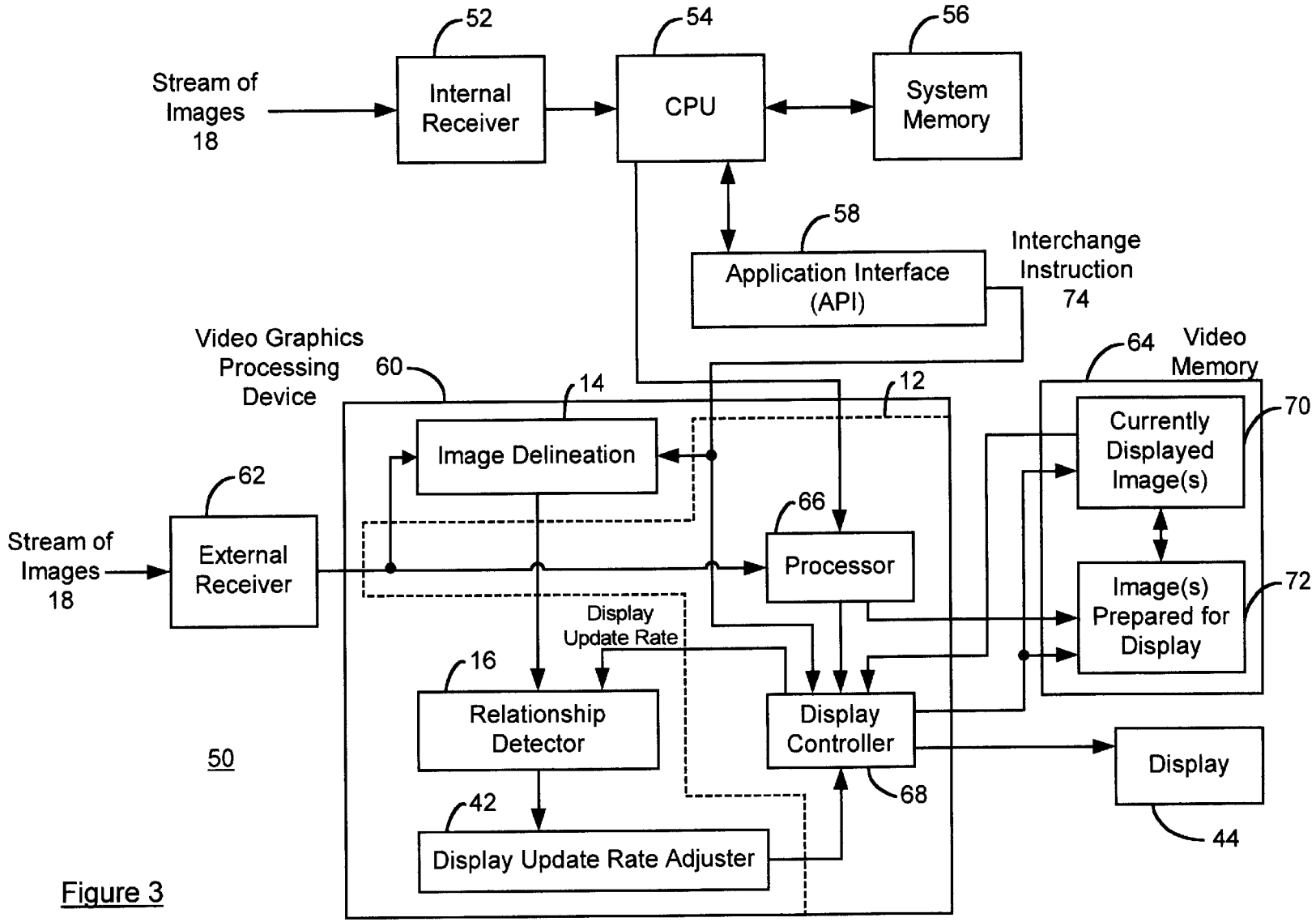
FIG. 3 illustrates a schematic block diagram of a computer system that includes an update rate difference detector and adjustment circuit which is in accordance with the present invention.

FIG. 3 illustrates a schematic block diagram of a computer system 50 that includes an internal receiver 52, a central processing unit (CPU) 54, system memory 56, an application interface (API) 58, a video graphics processing device 60, an external receiver 62, video memory 64, and a display 44. The video memory 64 is shown to include a currently displayed image(s) memory section 70 and an image(s) prepared for display memory section 72. The video graphics processing device 60 is shown to include the image delineation detector 14, the relationship determiner 16, the display update rate adjuster 42, and the video graphics circuit 12. The video graphics circuit 12 is shown to include a processor 66, a display controller 68, and two nodes coupled to the image delineation detector 14.

The internal receiver 52 receives the stream of images 18 from a source within the computer 50, such as from a digital video disk, a compact disk storing multimedia data, or stored video data. The stream of images is provided to the CPU 54, which processes the stream of images 18 based on programming instructions stored within the system memory 56. The processed stream of images is provided to the processor 66 for video processing. In addition, the API 58, based on data from the CPU 54, generates interchange instructions 74, which are provided to the image delineation detector 14 and the display controller 68.

The image delineation detector 14 utilizes the interchange instructions to determine image delineations. Since the interchange instructions are provided to cause the data in the image prepared for display section 72 to be swapped into the currently displayed image memory section 70 and are done so based on the image update rate, by proper detection, the image delineation detector 14 can accurately detect image delineations. The detected image delineations are then provided to the relationship determiner 16 to generate a relationship which, in turn, is used to produce the adjust display update rate signal 48. As mentioned above, this update rate signal 48 may cause the display update rate to be adjusted and/or to utilize a display image pattern.

The display controller 68 reads the video data from the currently displayed image memory section 70 and provides the data to the display 44. How the data is displayed is based on the adjust display update rate signal 48. When the display control 68 receives an interchange instruction 74, it provides control signals to the currently displayed image memory section 70 and the image prepared for display memory section 72, such that video data representative of the image that was prepared for display is now written into the currently displayed image memory section 70 such that it may be provided to the display 44. As one skilled in the art will readily appreciate, the data stored in the image prepared for display memory section 72 does not have to be written into the currently displayed image memory section 70, such a change can occur by changing which section 70 and 72 is being read from and which section is being written to. Thus, the section that is being read from is the currently displayed image memory section 70 and the section being written to is the image prepared for display memory section 72.

The external receiver 62 receives the stream of images 18 from an external source, such as a DVD player, a VCR player, broadcast television, cable television, and provides the stream of images 18 to the image delineation detector 14 and the processor 66. When the stream of images 18 is received in this manner, it typically contains an end of image signal, which indicates the image delineation. As such, the image delineation detector 14 can readily detect the image delineations and provide them for processing as described above.

The processor 66 processes the stream of images 18 to provide video data to the video memory 64 and controlling information to the display controller 68. The controlling information includes, at a minimum, the interchange instruction 74 such that video data can be interchanged between the memory sections 70 and 72 of the video memory 64. As one skilled in the art will readily appreciate, the circuit elements of this computer system 50 may be implemented in software and/or hardware.

Figure 4:
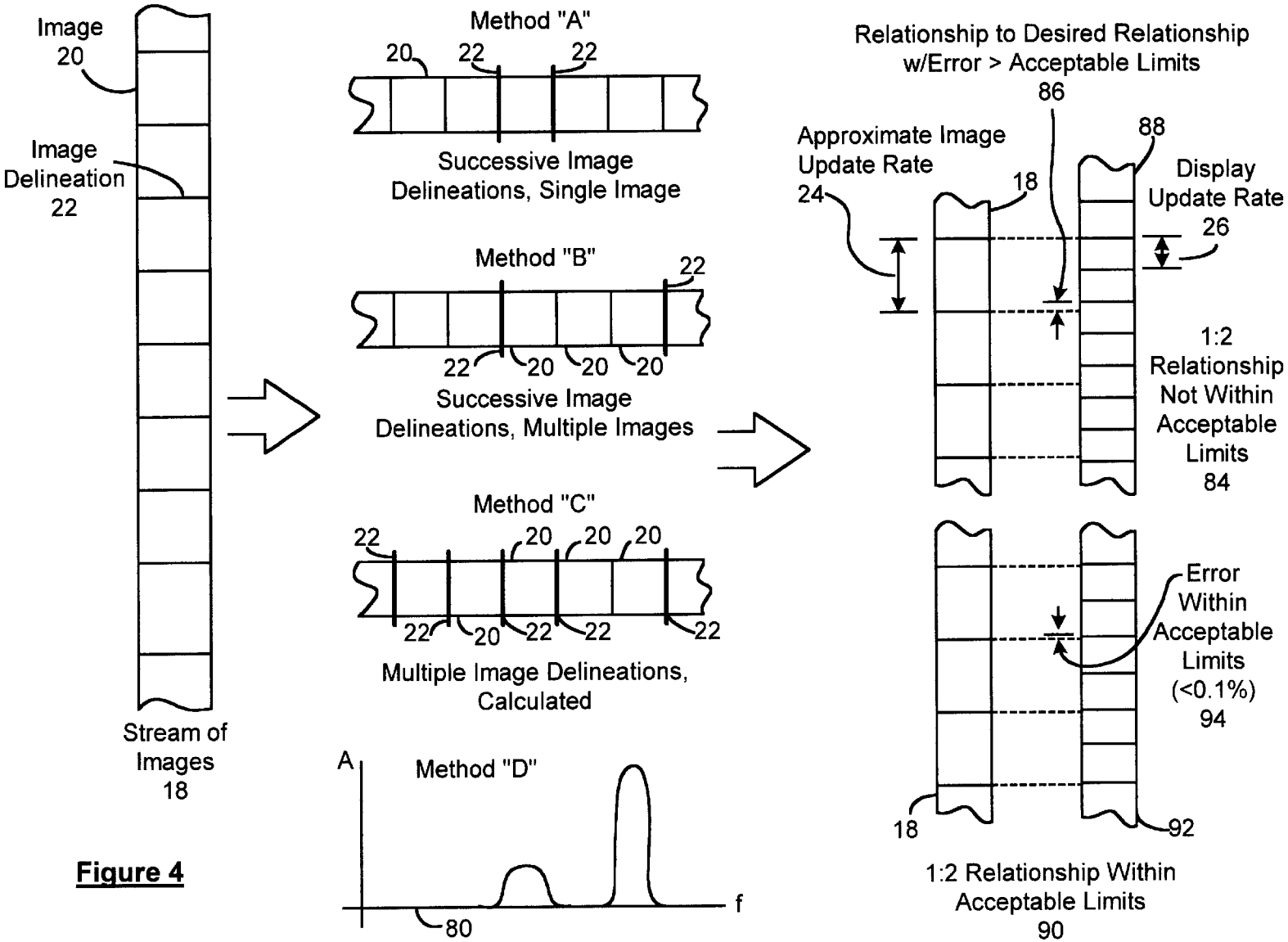
FIG. 4 illustrates a graphical representation of a relationship between an image update rate and a display update rate that is within acceptable limits and a relationship that is not within acceptable limits, such graphical representation is in accordance with the present invention.

FIG. 4 illustrates a graphical representation of a relationship 84 between an image update rate 18 and a display update rate 92 that is within acceptable limits 86 and a relationship 90 that is not within acceptable limits 94. In addition, this FIG. 4 illustrates various methods in which the relationship detector 16 can determine the image update rate 24. As shown, the stream of images 18 includes a plurality of time sequential images 20 having image delineations 22 to distinguish between the images 20. The first method "A" which the relationship detector 16 may use is to detect two successive image delineations 22, which provide the boundaries for a single image 20. Measuring the time difference between the two image delineations 22 and taking the inversion, yields an approximate image update rate.

A second method "B" has the relationship detector 16 detecting two successive image delineations 22 that establish the boundaries for several images 22. By knowing the number of images delineated by the image delineations 22, the image update rate can be readily calculated. Such calculations would first include determining the elapsed time between the image delineations 22, taking the inverse of this time, and then dividing this rate by the number of images within the image delineations 22. As can be seen by comparing method "A" with method "B", successive image delineations does not necessarily mean numerically consecutive image delineations.

A third method "C" has the relationship detector 16 detecting a plurality of image delineations and calculating therefrom a plurality of approximate image update rates. As shown, the image delineations 22 have been highlighted by bold lines extended beyond the borders of the stream of images. The first four image delineations 22 are shown to be numerically consecutive, thus defining three images. The fourth and fifth image delineations define the boundaries for two images. From this information, the image update rate and be easily calculated. Such a calculation would include determining the image update rate for the first three images (as described in method "A"), then determining the image update rate for the next two images (as described in method "B"), and finally taking the average of the five image update rates.

A fourth method "D" has the relationship detector 16 detecting the frequency of the plurality of image delineations using frequency analysis. Assuming that the image delineations of method "C" were also the image delineations for method "D", the resulting frequency response 80 would have two frequency peaks. The larger peak represents the numerically consecutive image delineations (hence having the higher frequency), while the smaller peak represents the non-numerically consecutive image delineations. The magnitude of the peaks is based on the number of image delineations having a particular frequency, while the highest frequency peak will be indicative of the image update rate.

The relationship within the acceptable limits 90 is shown to include a stream of images 18 having an image update rate and a stream of displayed images 92 having a display update rate. As shown, the display update rate is almost exactly twice the image update rate, thus establishing a 1:2 relationship, which, for example, could be established by an image update rate of 50 Hz and a display update rate of 100 Hz. A 1:2 relationship is one of the plurality of desired relationships because the integer nature of the relationship and that a pattern generated therefor produces negligible adverse visual affects. Even though the relationship is sufficiently similar to the desired relationship of 1:2, an error 94 may still exist. If the error 94 is small (less than 0.1%), the determined relationship is within acceptable limits.

FIG. 4 further illustrates an example of a relationship not within the acceptable limits 84. As shown, the stream of images 18 has an image update rate that is about one-half of the display update rate of a stream of displayed images 88. For example, if the image update rate is 50 Hz, but the display update rate is 103 Hz, the resulting relationship is 50:101.5, which is equal to 1:2.06. In this example, the error rate would be approximately 3% which is beyond the acceptable limits. To illustrate, the 1:2.06 relationship means that for every one hundred images of the stream of images received, two hundred and six would need to be displayed. In other words, for every two hundred and six images displayed, six of them would have to be a repeat image. If equally spaced, i.e., one repeat images every 33 image, which, for the 103 Hz display update rate is once every 300 mSecs. As previously mentioned, when an image is repeated in sporadically, or at a very low frequency, it is perceivable to the human eye. In contrast, when an image is repeated in a given pattern having a relatively high frequency, (i.e., beyond perception by the human eye), it produces negligible adverse visual affects.

Figure 5:
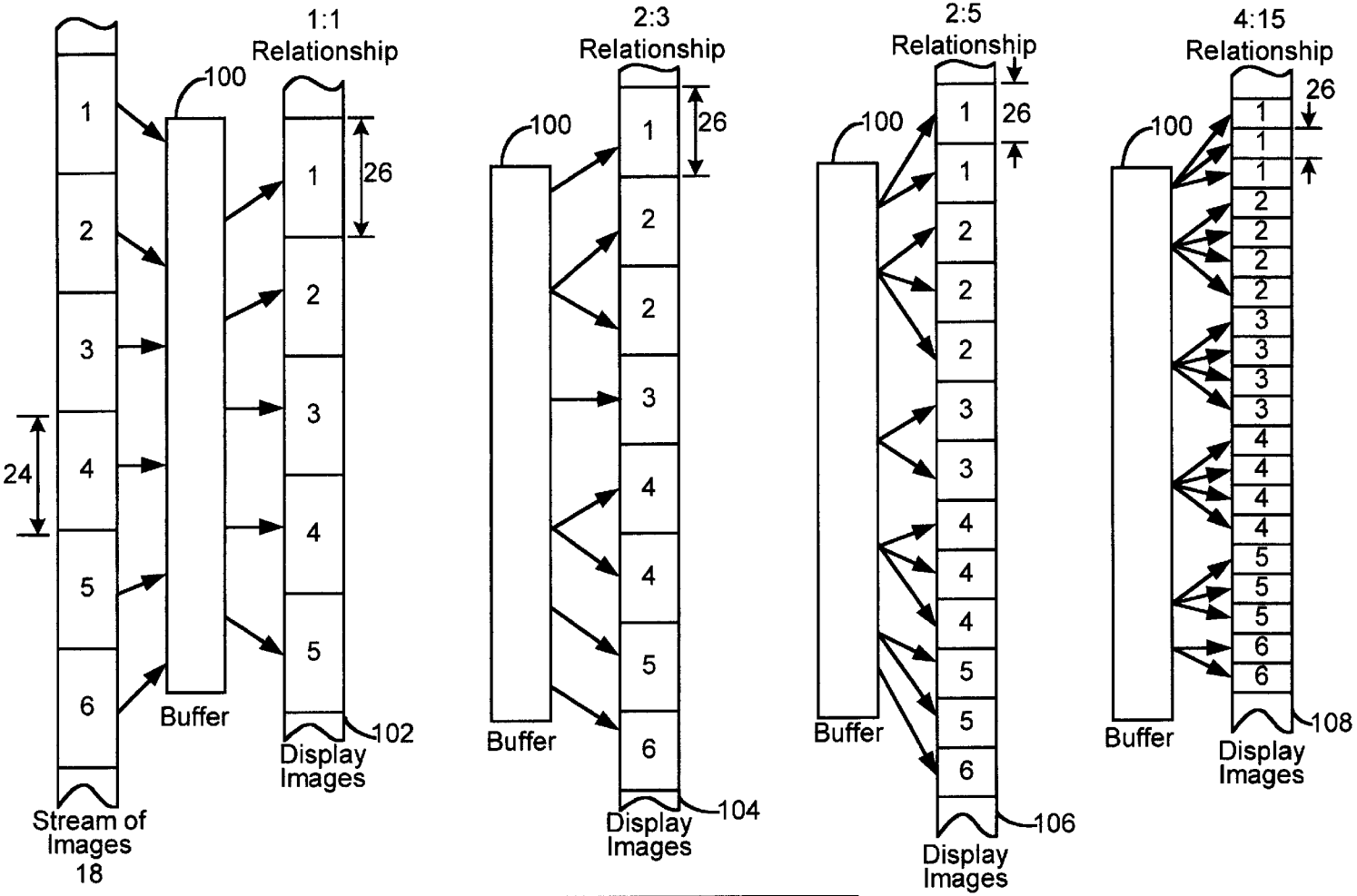
FIG. 5 illustrates a graphic representation of several desired relationships between the image update rate and the display update rate, which is in accordance with the present invention.

FIG. 5 illustrates an example of but a few possible graphic representations of desired relationships between the image update rate and the display update rate. Also illustrated is a table 110 that includes various image update rates, display update rates, and desired relationships. The image update rates include 59.94 Hz (which is defined by the North American television standard NTSC), 24 Hz (which is defined by the motion picture industry), and 50 Hz (which is defined by the European television standard PAL). The display update rates of 60 Hz and 90 Hz are for currently manufactured North American computer displays, or CRTs. From these values, the desired relationships are: 1:1 (image of 59.94 Hz and display of 59.94 Hz, which assumes that the display update rate has been adjusted to 59.94 Hz); 2:5 (image of 24 Hz and display of 60 Hz); 5:6 (image of 50 Hz and display of 60 Hz); 2:3 (image of 59.94 Hz and display of 89.91 Hz); 4:15 (image of 24 Hz and display of 90 Hz); and 5:9 (image of 50 Hz and display of 90 Hz).

The stream of images 18 is shown to include six images (designated 1–6) which are stored in a buffer 100. In the first desired relationship example, the desired relationship is 1:1, which indicates that the display image update rate 26 is substantially equal (error 94 is within acceptable limits) to the image update rate 24. As each image is received, it is stored in the buffer 100 and subsequently provided to the stream of display images 102 for display. Because of the one to one relationship, each received image from the stream of images 18 is only displayed once in the stream of displayed images. In practice, this is the most desirable relationship because it provides the clearest displayed images. As one skilled in the art will readily appreciate, the timing of reading from and writing to the buffer 100 will need to accommodate the particular display pattern being used. As one skilled in the art will further appreciate, the image delineation of the stream of images may, for some applications, need to match, or be in sync with, the image delineation of the stream of displayed images.

The next desired relationship is for a 2:3 relationship. As shown, the buffer 100 (which is assumed to have been written to by the stream of images 18), provides the images for display as the stream of displayed images 104. How the images are provided from the buffer 100 for display is determined by the display update rate adjuster 42 of FIGS. 2 and 3. To achieve the 2:3 relationship a display pattern of 121212. . . is used. In other words, for every two images received, three images need to be displayed, which produces the pattern of displaying: image 1 once, image 2 twice, image 3 once , image 4 twice, and so on. By having a pattern at this rate, the human eye may perceive a slight shadow, in comparison to the 1:1 relationship, but will not perceive any jumps (i.e., perceived inconsistencies in the flow of motion in the display of the images). The slight shadow would be considered to be of negligible adverse visual affects.

The next desired relationship is for a 2:5 relationship. In this example, for every two images received by the buffer 100, five images need to be displayed in the stream of displayed images 106. To achieve the 2:5 relationship a pattern of 232323. . . is employed. As shown, the 232323 pattern has image 1 being displayed twice, image 2 being displayed three times, image 3 being displayed twice, image 4 being displayed three times, and so on. This pattern may also produce a shadow that may be perceived by the human eye, but will not produce a perceivable jump.

The final desired relationship illustrated is for a 4:15 relationship. In this example, for every four images received by the buffer 100, fifteen images need to be displayed in the stream of displayed images 108. To achieve the 4:15 relationship a pattern of 34443444 . . . needs to be employed. Such a pattern is readily determinable from the desired relationship. In this example, the desired relationship is 4:15 which reduces to 1:3.75. Thus for every image received, 3.75 need to be displayed. The pattern is then calculated by solving the following two equations: $3.75=(4x+3y)/(x+y)$ and $3.75-3=4x/(x+y)$ which yields $x=3$ and $y=1$, hence the pattern 34443444. In general, to find the pattern for a relationship of 1:R.rr, the equations of $R.rr=(aX+bY)/(a+b)$ and $0.rr=aX/(a+b)$, where R is the integer portion of the ratio, X equals R+1, and Y equals R. The resulting pattern will then be Y 'b' times and X 'a' times.

Figure 6:
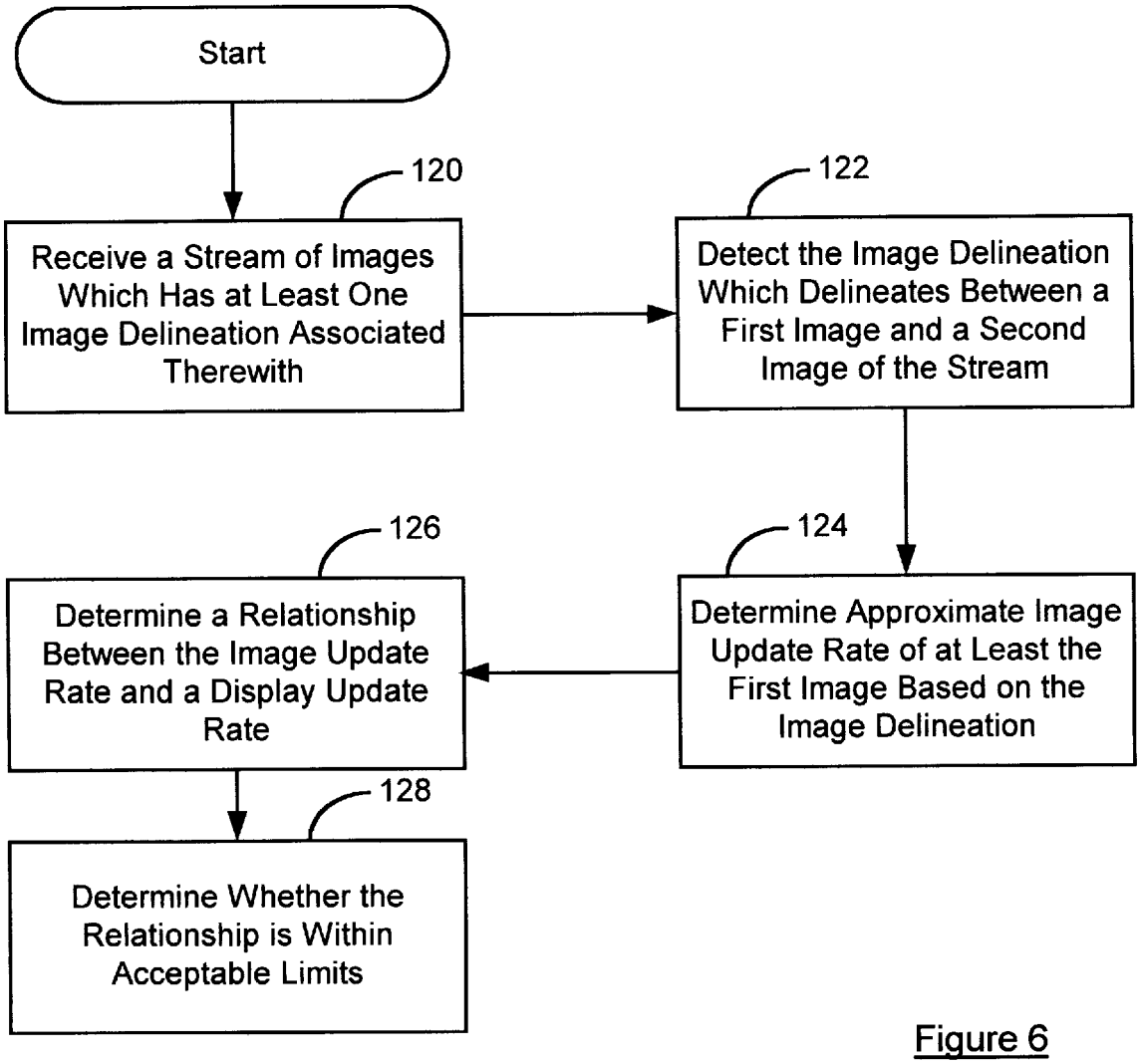
FIG. 6 illustrates a logic diagram that may be utilized to determine differences between the image update rate and the display update rate in accordance with the present invention.

FIG. 6 illustrates a logic diagram that may be utilized to determine differences between the image update rate and the display update rate in accordance with the present invention. The process begins at step 120 where a stream of images is received, the stream of images having at least one image delineation associated therewith. The process then proceeds to step 122, where the image delineation is detected and is used to delineate between a first image of the stream of images and second image of the stream of images. Next, the process proceeds to step 124, where an approximate image update rate is determined from at least the first image based on the image delineation. Having made this approximation, the process proceeds to step 126, where a determination is made as to a relationship between the image update rate and the display update rate. At this point, the process proceeds to step 128, where a determination is made as to whether the relationship is within acceptable limits.

Figure 7:
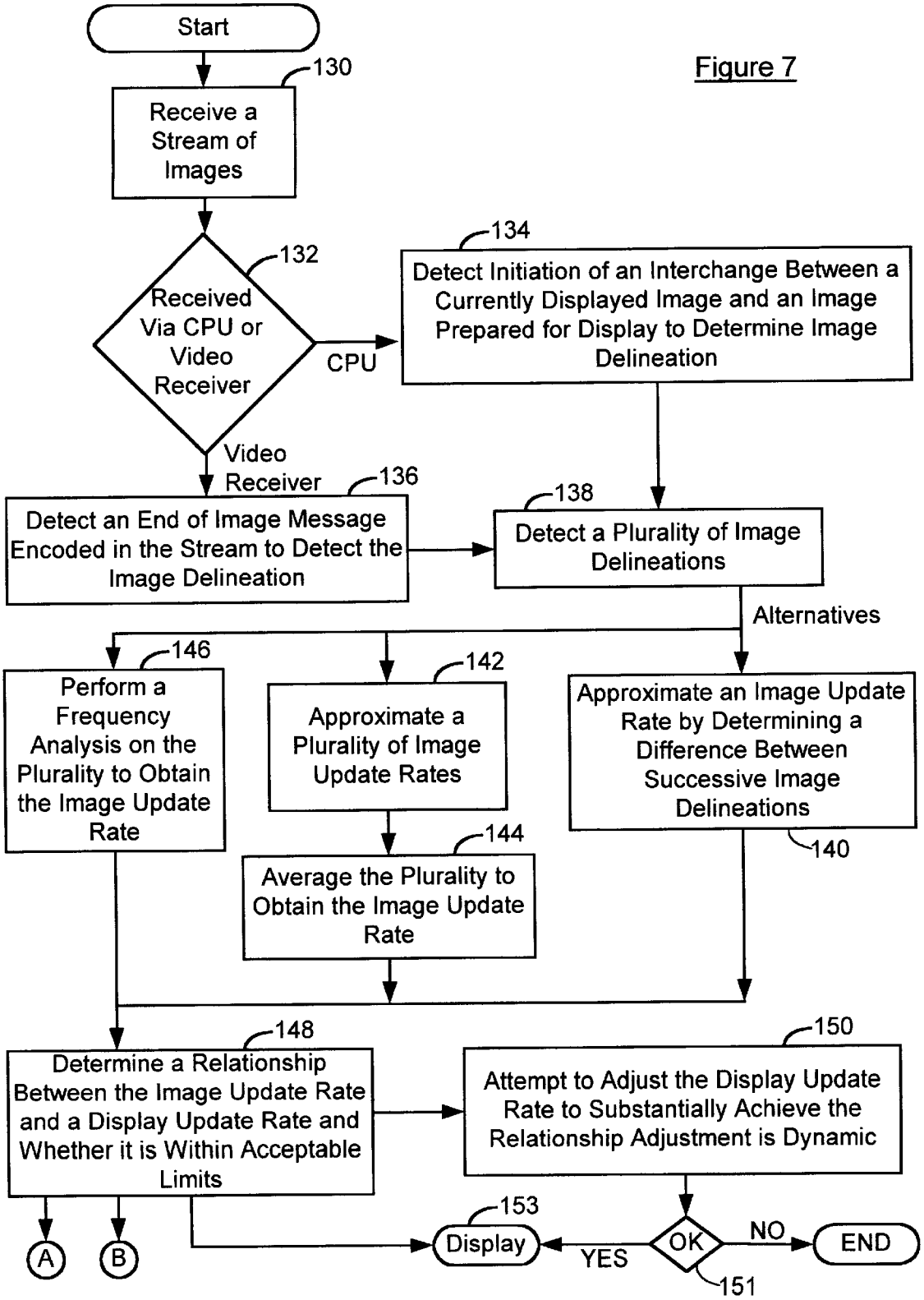
FIGS. 7 and 8 illustrate an alternate logic diagram that may be utilized to determine differences between the image update rate and the display update rate in accordance with the present invention.
Figure 8:
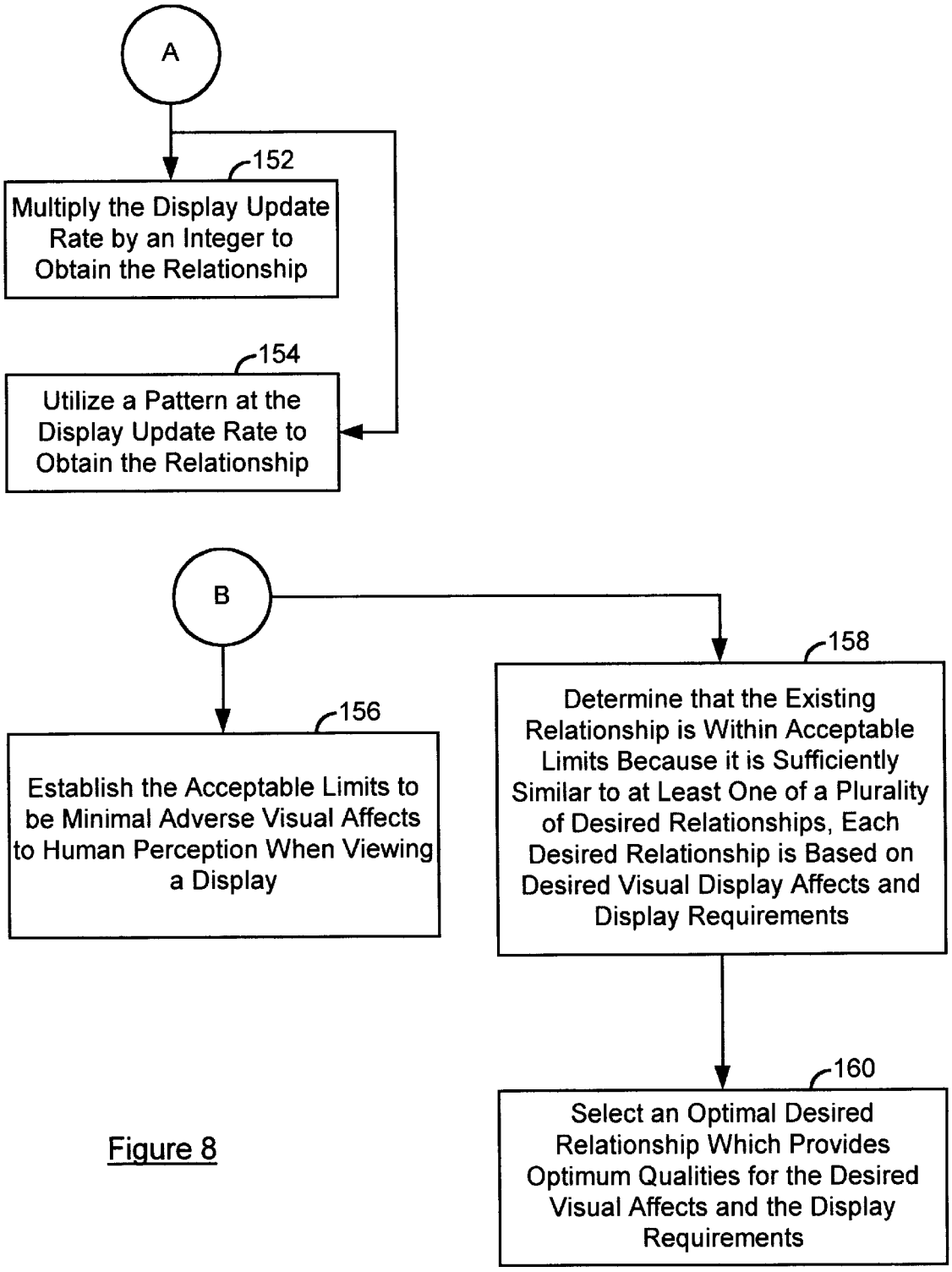

FIGS. 7 and 8 illustrate an alternate logic diagram that may be utilized to determine differences between the image update rate and the display update rate. The process begins at step 130, where a stream of images is received. The process then proceeds to step 132, where a determination is made as to whether the stream of images was received via a CPU or a video receiver. Recall from the discussion of FIG. 3, the stream of images may be received either by the internal receiver 52 or the external receiver 54. For the purposes of the this inquiry at step 132, the stream is received by the CPU if received by the internal receiver 54 and by the video receiver when received by the external receiver 54. If the stream was received via the CPU, the process proceeds to step 134, where an initiation of an interchange between currently displayed image memory section (reference no. 70 of FIG. 3) and an image prepared for display memory section (reference no. 72 of FIG. 3) is detected. From the detection of the interchange, an image delineation is determined. In furtherance of step 134, step 138 provides the step of detecting a plurality of image delineations from a plurality of interchanges.

If, however, the stream of images was received by the video receiver, the process proceeds to step 136, where an end of image is detected to identify the image delineation. Regardless of how the image delineation was determined, the process proceeds to one of the alternative steps 140, 142, or 146. If step 140 is the chosen alternative, an image update rate is approximated by determining a difference between successive image delineations. As mentioned above with reference to FIG. 4, successive image delineations may be numerically consecutive as shown in method "A", or non-numerically consecutive as shown in method "B". If, however, step 142 is the chosen alternative step, a plurality of image update rates are approximated. The process then proceeds to step 144, where a calculation is made to obtain the image update rate. This alternative was graphically illustrated as method "C" in FIG. 4.

If, however, the alternative step chosen was step 146, the image update rate is done by a frequency analysis. Regardless of how the image update rate was determined, the process proceeds to step 148, where a relationship between the image update rate and a display update rate is determined. If the relationship is within acceptable limits, the process proceeds to step 153, where the stream of images is displayed based on the relationship. Note that even though the relationship is within the acceptable limits the display update rate is still adjusted while the images are being displayed such that, over time, the relationship between the image update rate and the display update rate substantially equals a desired relationship.

If, however, the relationship is not within acceptable limits, the process proceeds to step 150, where an attempt is made to dynamically adjust the display update rate to bring the relationship within the acceptable limits. Next, the process determines at step 151 whether it is feasible to make the dynamic adjustment. If so, the adjustment is made, and the process proceeds to step 153. If, however, the dynamic adjustment is not feasible, i.e., would cause adverse visual affects, the images may still be displayed despite the adverse visual affects, or the process would try to align the relationship with a different desired relationship.

As shown, step 148 further branches to nodes A and B. The steps affiliated with node A discuss but a few of the possible desired relationships and the steps affiliated with node B discuss how the acceptable limits are set. At step 152 (FIG. 8), a relationship is within acceptable limits if the display update rate is an integer multiple of the image update rate. At step 154, a display image repeat pattern is utilized at the display update rate to obtain a relationship that is within the acceptable limits. At step 156, the acceptable limits are established to be minimal, or negligible, adverse visual affects to human perception when viewing a display. At step 158, a determination is made as to whether the existing relationship is within acceptable limits when it is sufficiently similar to at least one of a plurality of desired relationships. A desired relationship is based on desired visual affects (i.e., no jumps) and the display requirements. Finally, at step 160, an optimal desired relationship is selected from the at least one desired relationship, wherein the selected relationship provides optimum qualities for the desired visual affects and the display requirements.

As discussed above, the present invention provides a method and apparatus that allows a display device that has a display update rate (i.e., refresh rate) that is the same or different from an image update rate to display images with acceptable adverse visual affects (i.e., only jumps in the display of objects in motion due to image repeating or image dropping that conform to the presentation mechanism associated with a desirable relationship). In essence, this is done by assuring that the relationship between the image update rate and display update rate is sufficiently similar to a desired relationship, a display pattern of images can be used which does not produce an undesired jump.

We claim:

1. A method for detecting image update rate differences, the method comprising the steps of a) receiving a stream of images, wherein the stream of images has at least one image delineation associated therewith;

b) detecting the image delineation which delineates between a first image of the stream of images and a second image of the stream of images;

c) determining approximate image update rate of at least the first image based on the image delineation;

d) determining a relationship between the image update rate to a display update rate; and e) determining whether the relationship is within acceptable limits.

2. The method of claim 1, wherein step (b) further comprises detecting an end of image message encoded in the stream of images to detect the image delineation.

3. The method of claim 1, wherein step (b) further comprises detecting initiation of interchanging between a currently displayed image and an image prepared for display to detect the image delineation.

4. The method of claim 1, wherein step (b) further comprises detecting a plurality of image delineations.

5. The method of claim 4, wherein step (c) further comprises approximating the image update rate by determining a difference between successive image delineations.

6. The method of claim 5 further comprises:

approximating a plurality of image update rates;

averaging the plurality of image update rates to obtain the image update rate.

7. The method of claim 4 further comprises performing a frequency analysis on the plurality of image delineations to obtain the image update rate.

8. The method of claim 1, wherein step (e) further comprises adjusting the display update rate to substantially achieve the relationship over time, when the relationship is not within the acceptable limits.

9. The method of claim 1, wherein step (e) further comprises determining that the display update rate is an integer multiple of the image update rate, which is a desired relationship and within the acceptable limits.

10. The method of claim 1, wherein step (e) further comprises determining that a display image repeat pattern of the display update rate is within the acceptable limits.

11. The method of claim 1, wherein step (e) further comprises establishing the acceptable limits to be minimal adverse visual affects to human perception when viewing a display that is displaying the stream of images.

12. The method of claim 1, wherein step (e) further comprises determining that the relationship is within the acceptable limits because of being sufficiently similar to at least one of a plurality of desired relationships, wherein each of the plurality of desired relationships is based on desired visual display effects and display requirements.

13. The method of claim 12 further comprises determining a resulting error rate of the relationship to the at least one of a plurality of desired relationships is less than one to five percent to be within the acceptable limits.

14. The method of claim 12 further comprises selecting an optimal desired relationship from the at least one of the of desired relationships, wherein the optimal desired relationship provides optimum qualities for the desired visual display effects and the display requirements.

15. An apparatus for detecting image update rate differences comprising:

a video graphics circuit operably coupled to receive the stream of images, wherein the video graphics circuit has access to a display update rate; and an image delineation detector operably coupled to the video graphics circuit, wherein the image delineation detector that detects an image delineation of the at least one image delineation, the image delineation delineates between a first image of the stream of images and a second image of the stream of images;

relationship determiner operably coupled to the image delineation detector and the video graphics circuit, wherein the relationship determiner determines a relationship between a image update rate and the display update rate and determines whether the relationship is within acceptable limits.

16. The apparatus of claim 15, wherein the image delineation detector further functions to detect a plurality of image delineations.

17. The apparatus of claim 16, wherein the relationship determiner further functions to detect the image update rate by determining a difference between successive image delineations.

18. The apparatus of claim 16, wherein the relationship determiner further functions to determine a plurality of image update rates and calculates the image update rate from the plurality of image update rates.

19. The apparatus of claim 16, wherein the relationship determiner further comprises a frequency analyzer circuit that determines the image update rate based on a frequency analysis of the plurality of the image update rates.

20. The apparatus of claim 15 further comprises a display update rate adjuster operably coupled to the video graphics circuit, wherein the display update rate adjuster adjusts the display update rate such that the relationship between the image update rate and the display update rate is within the acceptable limits.

21. A digital storage medium for storing program instructions, that when read by a digital processing device, causes the digital processing device to detect image update rate differences, the digital storage medium comprising:

a first storage means for storing program instructions that, when read by the digital processing device, causes a stream of images to be received, wherein the stream of images has at least one image delineation associated therewith;

a second storage means for storing program instructions that, when read by the digital processing device, causes detection of the image delineation which delineates between a first image of the stream of images and a second image of the stream of images;

a third storage means for storing program instructions that, when read by the digital processing device, causes determination of an approximate image update rate of at least the first image based on the image delineation;

a fourth storage means for storing program instructions that, when read by the digital processing device, causes determination of a relationship between the image update rate and a display update rate; and a fifth storage means for storing program instructions that, when read by the digital processing device, causes determination of whether the relationship is within acceptable limits.

22. The digital storage medium of claim 21, wherein the second storage means further stores program instructions that cause the detection of the image delineation to be done by detecting an end of image message encoded in the stream of images.

23. The digital storage medium of claim 21, wherein the second storage means further stores program instructions that cause the detection of the image delineation to be done by detecting initiation of interchanging between a currently displayed image and an image prepared for display.

24. The digital storage medium of claim 21, wherein the second storage means further stores program instructions that cause the detection of the image delineation to be done by detecting a plurality of image delineations.

25. The digital storage medium of claim 24, wherein the third storage means further stores program instructions that cause the approximation of the image update rate to be done by determining a difference between successive image delineations.

26. The digital storage medium of claim 25, wherein the third storage means further stores program instructions that cause the approximation of the image update rate to be done by determining a plurality of image update rates and subsequently calculating the image update rate from the plurality of image update rates.

27. The digital storage medium of claim 21, wherein the fifth storage means further stores program instructions that cause establishment of the acceptable limits to be done by determining that the relationship is within the acceptable limits by being sufficiently similar to at least one of a plurality of desired relationships, wherein each of the plurality of desired relationships is based on desired visual display effects and display requirements.

28. A computing system comprising:

a central processing unit;

system memory operably coupled to the central processing unit;

a video receiver operably coupled to the central processing unit, wherein the receiver receives a stream of images that has at least one image delineation associated therewith;

a video graphics circuit operably coupled to the central processing unit; and video memory operably coupled to the video graphics processing device, the video memory includes a currently displayed image memory section and an image prepared for display memory section;

wherein the video graphics circuit further includes:

an image delineation detector operably coupled to detect an image delineation of the at least one image delineation, wherein the image delineation delineates between a first image of the stream of images and a second image of the stream of images;

relationship determiner operably coupled to the image delineation detector, wherein the relationship determiner determines a relationship between an image update rate to a display update rate and determines whether the relationship is within acceptable limits.

29. The computing system of claim 28 further comprises an application interface which provides an interchange instruction to the video memory to interchange stored data between the currently displayed image memory section and the image prepared for display memory section.

30. The computing system of claim 29, wherein the image delineation detector is further coupled to the application interface to receive the interchange instruction, wherein the image delineation detector utilizes the interchange instruction to determine the at least one image delineation.

31. The computing system of claim 28 further comprises, within the video graphics circuit:

a processor operably coupled to receive the stream of images and to provide the stream of images to the video memory;

a display controller operably coupled to receive the interchange instruction and data stored in the currently displayed image memory section, wherein the display controller instructs the currently displayed image memory section and the image prepared for display memory section to interchange, and to provide the data stored in the currently displayed image memory section to a display; and a display update rate adjusting circuit that is operably coupled to the display controller.

32. A computing system comprising:

a central processing unit;

system memory operably coupled to the central processing unit;

a video graphics circuit operably coupled to the central processing unit;

a video receiver operably coupled to the video graphics circuit, wherein the receiver receives a stream of images that has at least one image delineation associated therewith; and video memory operably coupled to the video graphics circuit, the video memory includes a currently displayed image memory section and an image prepared for displayed memory section;

wherein the video graphics circuit further includes:

an image delineation detector operably coupled to detect an image delineation of the at least one image delineation, wherein the image delineation delineates between a first image of the stream of images and a second image of the stream of images;

relationship determiner operably coupled to the image delineation detector, wherein the relationship determiner determines a relationship between an image update rate to a display update rate and determines whether the relationship is within acceptable limits.

33. The computing system of claim 32, wherein the stream of images further comprises an end of image signal.

34. The computing system of claim 33, wherein the image delineation detector utilizes the end of image signal to detect the at least one image delineation.

35. The computing system of claim 32 further comprises, within the video graphics circuit:

a processor operably coupled to receive the stream of images and to provide the stream of images to the video memory;

a display controller operably coupled to receive an interchange instruction and data stored in the currently displayed image memory section, wherein the display controller instructs the currently displayed image memory section and the image prepared for display memory section to interchange, and to provide the data stored in the currently displayed image memory section to a display; and a display update rate adjusting circuit that is operably coupled to the display controller.

* * * * *

UNITED STATES PATENT AND TRADEMARK OFFICE

CERTIFICATE OF CORRECTION

PATENT NO. : 6,028,586
APPLICATION NO. : 08/819922
DATED : February 22, 2000
INVENTOR(S) : Philip L. Swan et al.

It is certified that error appears in the above-identified patent and that said Letters Patent is hereby corrected as shown below:

In the Claims

Column 11, Claim 14, line 2, please replace “of the of desired” with --of the plurality of desired--.

Column 11, Claim 15, line 3, please replace “receive the stream” with --receive a stream--.

Column 11, Claim 15, line 8, please replace “detector that detects” with --detector detects--.

Column 11, Claim 19, line 4, please replace “analysis of the plurality” with --analysis of a plurality--.

Column 12, Claim 28, line 12, please replace “processing device, the video memory” with --circuit, the video memory--.

Column 13, Claim 31, line 6, please replace “receive the interchange” with --receive an interchange--.

Signed and Sealed this
Twenty-eighth Day of July, 2015

Michelle K. Lee

Michelle K. Lee
*Director of the United States Patent and Trademark Office*